United States Patent [19]

Smith

[11] 4,034,595

[45] July 12, 1977

[54] SHEET METAL WORKING TOOL

[76] Inventor: Glen R. Smith, Rte. 2, Box 183, Lewiston, Mich. 49756

[21] Appl. No.: 633,453

[22] Filed: Nov. 19, 1975

[51] Int. Cl.[2] ..... B21D 19/00

[52] U.S. Cl. ..... 72/458; 7/14.6; 29/267; 72/479; 81/3 R; 113/120 BB; 220/284

[58] Field of Search ..... 72/458, 479; 113/1 F, 113/116 QA, 121 F, 120 K, 120 BB, 120 DD; 220/284, 285, 286; 81/3 R, 3.1 R, 3.1 B, 3.1 D, 3.34, 3.36, 3.46, 3.46 A, 52.35; 29/267, 270, 200 D, 200 B, 200 H; 7/14.6

[56] References Cited

U.S. PATENT DOCUMENTS

| | | | |
|---|---|---|---|
| 1,286,488 | 12/1918 | Amberg | 72/458 |
| 1,299,974 | 4/1919 | Lorenz | 81/3.46 R |
| 1,656,104 | 1/1928 | Dunbar | 72/479 |
| 1,676,648 | 7/1928 | Hardiman | 81/3.46 |
| 2,694,326 | 11/1954 | Lewis | 81/3 R |
| 2,938,413 | 5/1960 | Pauls | 29/270 |
| 3,713,200 | 1/1973 | Burns | 29/267 |
| 3,736,643 | 5/1973 | Pepe | 29/267 |

*Primary Examiner*—C.W. Lanham
*Assistant Examiner*—Gene P. Crosby
*Attorney, Agent, or Firm*—Clarence A. O'Brien; Harvey B. Jacobson

[57] ABSTRACT

A sheet metal working tool for turning an edge of sheet metal perpendicular to the main portion of the sheet metal and for opening Pittsburgh locks formed in said metal.

9 Claims, 9 Drawing Figures

SHEET METAL WORKING TOOL

BACKGROUND OF THE INVENTION

1. Field of the Invention

This invention relates generally to a tool for use by sheet metal workers and has specific application to the sheet metal working field. A substantial part of sheet metal working involves turning edges and opening Pittsburgh-type locks for fabricating the desired sheet metal devices.

2. Description of the Prior Art

A common problem of prior art devices is that they cannot be used in limited or non-accessible places when a skilled craftsman is working and forming sheet metal components. Another problem has been that preformed articles of sheet metal commonly have connectors or Pittsburgh locks preformed in the sheet metal along appropriate edges thereof. Said locks often become damaged and/or crushed or deformed and before proper assembly of such sheet metal can be accomplished said locks have to be opened up. The tool as disclosed by this invention does an excellent job of this. It can also be used for opening or taking apart fittings that have been made up using said Pittsburgh locks.

The prior art shows various tool devices but none having the new and unique features as disclosed by this invention. Known prior art which may be pertinent to this invention are listed as follows: U.S. Pat. Nos. 1,676,648; 1,879,583; 2,283,789; 2,824,474; 2,938,413; 3,713,200; 3,736,643.

SUMMARY OF THE INVENTION

An object of the present invention is to provide a sheet metal working tool for turning the edge of sheet metal so that said edge will be approximately 90 degrees to the plane of the main piece of metal.

Another object of this invention is a tool for turning edges on a piece of sheet metal in inaccessible places or around holes, etc.

A further object of this invention is to provide a tool for opening Pittsburgh locks that have been mashed in forming or in shipping.

A further object of this invention is to provide a tool for opening Pittsburgh locks which have been already assembled and where it is desired to disassemble said pieces of sheet metal by loosening and opening said locks.

One of the significant features of the tool disclosed by this invention is that it is simple and easy to manufacture, and yet works extremely well and in limited and inaccessible places.

It is small and compact and easily carried by any sheet metal craftsman, and does an excellent job for said craftsman. The tool can be used to turn edges in cramped and difficult-to-reach spots, it can be used to open deformed Pittsburgh locks, and also used to unlock said Pittsburgh-type locks that have already been closed in prior construction of sheet metal components.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
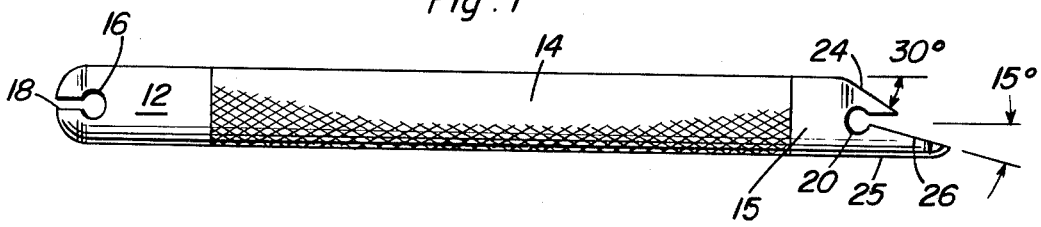
FIG. 1 is a side elevational view of the device of this invention.
Figure 2:
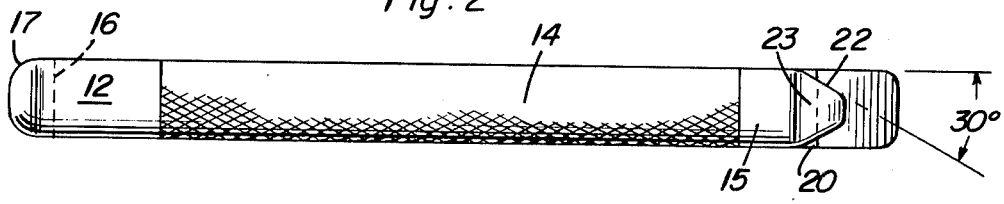
FIG. 2 is a top plan view of the tool of this invention.
Figure 3:
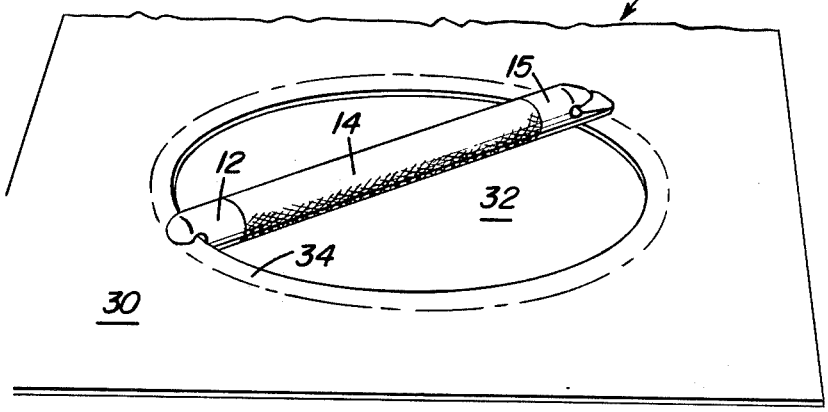
FIG. 3 is a perspective view of the tool in use.

Referring to FIG. 3 of the drawings, reference numeral 10 indicates the sheet metal working tool of this invention as in use. The tool is formed from a rod of cold rolled steel of approximately ½ inch in diameter and approximately 6 inches in length. One end of said tool labeled 12 is constructed as an edge turner for sheet metal, the main body portion 14 is appropriately knurled therealong for good grip of said tool by the skilled craftsman, and the other end of said tool 15 has the Pittsburgh lock working structure formed thereon.

The edge turning portion 12 of the tool has a hole of approximately 5/32nd of an inch drilled therethrough as shown by reference numeral 16. The end of the tool is suitably rounded as shown by numeral 17, said rounding being approximately 21/64th inch radius from the center line of the hole 16. And a 1/16th inch slot 18 is cut along the center line of the tool and in parallel with the longitudinal axis of the tool and connecting with the hole 16. The center line of the hole 16 is approximately 15/64th of an inch from the tip of the tool. These dimensions are appropriate for edge turning a ¼th inch edge on sheet metal. If edges of other dimensions are or would be desired, then appropriate changes in the dimensions set forth above would be required. However, in the sheet metal field in the United States ¼ inch edges are the standard.

Figure 4:
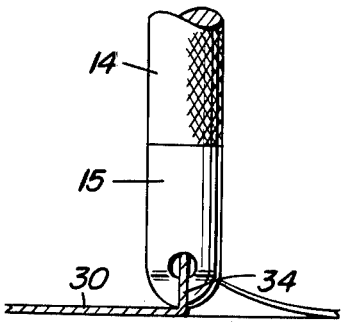
FIG. 4 is a fragmental elevational view of the tool in use as in FIG. 3.
Figure 5:
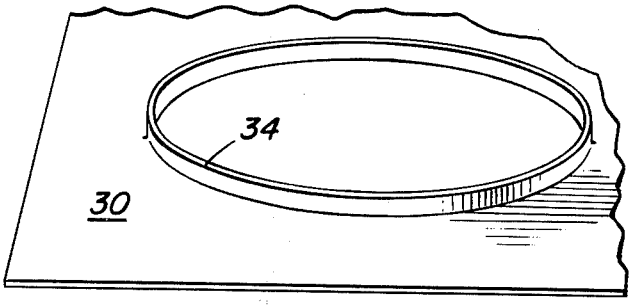
FIG. 5 is a perspective view of the edge formed by this tool after completion of the use thereof.

The use of this tool as an edge turner will now be described. Looking at FIGS. 3, 4 and 5 it can be seen that the slot 18 which is just slightly wider than the thickness of the metal being turned is placed over the edge of a piece of sheet metal 30 having a central aperture therein 32. By lifting the main tool body member 14 upwardly, the edge 34 will be turned to a perpendicular position with respect to the main piece of sheet metal as best seen in FIG. 4. A short section of the edge is turned upwardly, then the tool is moved along the edge and another bite is taken of the edge and this portion turned upwardly until the entire edge of the aperture has been turned as seen in FIG. 5.

The end of the tool labeled 15 is used for opening deformed and assembled Pittsburgh locks and has a hole 20 drilled therein approximately 39/64th inch from the tip of the tool and on the center line of said tool with a forming tip 23 extending approximately 15/64th inch from the center line of the hole and having a bevel portion or face 24 which makes an angle of approximately 30 degrees from the center line of the device. The other portion of this tool structure is the end portion 25 which is 39/64th inch in length from the center line of the hole and has a flanged or tapered face 26 at an angle of approximately 15 degrees from the center line of the tool. The small slot formed between the flange surface 26 and the hole 20 is approximately 1/16th inch in thickness to correspond with the slot 18. The tip portion 23 also has tapered flange side portions 22 which form an approximately 30 degree angle with the center line of the tool. These dimensions may be varied slightly but for proper operation of said tool should be adhered to quite closely as it has been discovered in use that these dimensions are quite critical and are important to the proper functioning of the tool.

Figure 6:
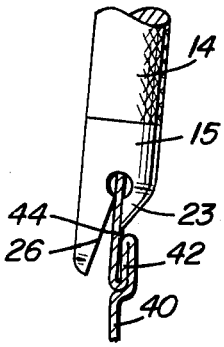
FIGS. 6 and 7 are sequential, fragmental elevational views of the tool in use for opening a deformed Pittsburgh lock.
Figure 7:
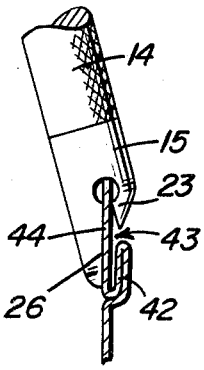

The use of the tool for opening Pittsburgh locks will now be described. Referring to FIGS. 6 and 7, the tool is shown in use for opening a deformed section of Pittsburgh lock. As seen in FIG. 6, the lock which is normally open has been deformed and is in a closed position. That is, the main portion of the sheet metal structure 40 having lock portions 42 and 44 which are bent back and forth on the metal, are deformed or closed. In such a closed position it is impossible for the sheet metal craftsman to assemble the lock to another piece of sheet metal as is necessary when assembling sheet metal components. By placing the tool as shown in FIG. 6, the tool handle 14 would be moved to the left and the portion 23 of the tool would cause the gap 43 between 40 and 42 to be opened as seen in FIG. 7. Then the handle member 14 would be moved along the Pittsburgh lock to open the next deformed section. Thus by rocking the tool back and forth and moving it along the edge of the Pittsburgh lock the entire deformed section can be opened so the lock is ready for use.

Figure 8:
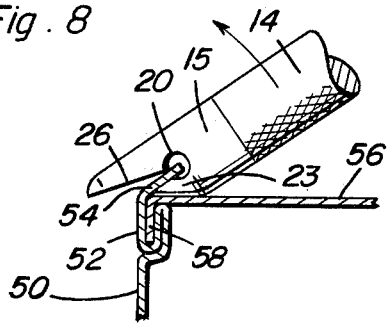
FIGS. 8 and 9 are sequential, fragmental elevational views of the tool opening a closed Pittsburgh lock as often encountered in the field.
Figure 9:
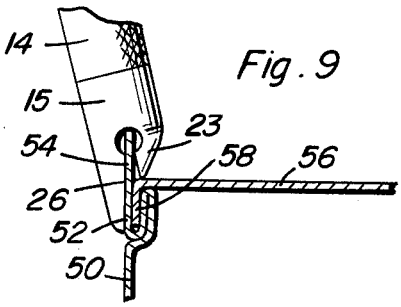

Many times it is desired to disassemble sheet metal components that have been put together with Pittsburgh locks and such disassembly is very easy with this tool. FIGS. 8 and 9 of the drawing show this procedure. The tip 23 of the tool is inserted and forced against the edge 54 which has been closed along the attaching piece of sheet metal 56 with edge 58 thereon as best seen in FIG. 8. The 30 degree angle of the face 24 of the tip 23 is such that relatively small pressure is needed to lift the edge 54 from its closed position against sheet metal 56. This edge is normally approximately 1/4 inch and so the tool point of portion 23 will reach the junction before the edge of the metal bottoms in the hole 20. Then by rocking the handle 14 upwardly or to the left, as seen in FIGS. 8 and 9, the portion 54 will be opened, as seen in FIG. 9, and in line with the edge 52 of the Pittsburgh lock. At this point the edge 58 of the other piece of sheet metal 56 is available for easy removal thereof from the Pittsburgh lock of part 50 and the component parts 50 and 56 may be separated. Obviously the tool would be moved along the edge of the lock for the entire length thereof so the lock would be completely open before attempting to separate the component pieces of sheet metal.

From the above explanation and description of this new and unique tool it can be seen how flexible and readily adaptable it is for use when working with sheet metal.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A tool for working on sheet metal to turn edges and open Pittsburgh locks comprising; a metal rod of steel having means at one end for edge turning, and means at the other end for opening Pittsburgh locks, the means for edge turning including a slot extending inwardly the depth of the desired edge and of the approximate width of the thickness of metal which it is desired to turn, the slot being approximately 1/16th inch in thickness and approximately 1/4 inch in depth, a hole provided parallel to and at the innermost end of said slot, said hole being of approximately 5/32nd inch in diameter, and the means for opening Pittsburgh locks including a hole drilled through the steel rod and in parallel with the first hole set forth above but at the other end of said rod, said hole having a slot of approximately 1/16th inch opening to the edge of said tool.

2. The structure as set forth in claim 1 wherein the tip portion of the rod on one side of said Pittsburgh lock opening slot has a sloping flange surface of approximately 30° from the center line of said rod to provide a wedging surface for initially opening the side edge of closed Pittsburgh locks.

3. The structure as set forth in claim 2 wherein the tool has an extending tip on the opposite side of said slot with a flange surface of approximately 15 degrees from the center line of said rod for engaging the other side of a Pittsburgh lock for opening of same.

4. The structure as set forth in claim 3 including the said tip portions on either side of said slot being suitably flanged and rounded for proper engagement of the tool with the sheet metal being worked.

5. A tool for working on sheet metal to turn edges and open Pittsburgh locks comprising; a metal rod of steel having means at one end for edge turning, and means at the other end for opening Pittsburgh locks, and the means for opening Pittsburgh locks including a hole drilled through the steel rod adjacent one end thereof and flanged tips on said rod on either side of said hole forming a slot therewith.

6. The structure as defined in claim 5 wherein one flanged tip on one side of said hole and slot has a surface making an angle of approximately 30° with the center line of said tool and the other flanged tip has a surface making an angle of approximately 15° from the center line of said tool, said surfaces being properly shaped for engagement with and working of Pittsburgh locks formed in sheet metal structures.

7. The structure as defined in claim 6 wherein the means for edge turning includes a slot extending inwardly the depth of the desired edge and of the approximate width of the thickness of metal which it is desired to turn.

8. The structure as defined in claim 7 wherein the slot is approximately 1/16 inch in thickness and approximately 1/4 inch in depth.

9. The structure as set forth in claim 8 including a hole provided parallel to and at the innermost end of said slot, said hole being of approximately 5/32nd inch in diameter.

* * * * *